US005514197A

United States Patent [19]

Den

[11] Patent Number: 5,514,197

[45] Date of Patent: May 7, 1996

[54] AIR FILTER DEVICE FOR AN AIR-CONDITIONING APPARATUS

[75] Inventor: Jimmy Den, Taipei, Taiwan

[73] Assignee: Tekstarter Co., Ltd., Taipei, Taiwan

[21] Appl. No.: 384,991

[22] Filed: Feb. 7, 1995

[51] Int. Cl.[6] ..... B01D 33/00

[52] U.S. Cl. ..... 55/405; 55/493; 55/501; 55/528; 95/113; 95/277; 96/125

[58] Field of Search ..... 55/400, 402, 405, 55/493, 501, 528, DIG. 31, DIG. 45; 95/113, 277, 901; 96/125

[56] References Cited

U.S. PATENT DOCUMENTS

| | | | |
|---|---|---|---|
| 1,725,100 | 8/1929 | Pavlik | 55/405 |
| 1,846,057 | 2/1932 | Ilg | 55/405 |
| 2,286,920 | 6/1942 | Miller | 96/125 |
| 2,680,492 | 6/1954 | Kopp | 96/125 |
| 2,986,873 | 6/1961 | Smith | 55/402 |
| 4,108,778 | 8/1978 | Lambert et al. | 55/405 |
| 4,904,343 | 2/1990 | Giglia et al. | 55/528 |
| 4,978,375 | 12/1990 | Il Yoo | 55/493 |
| 5,312,467 | 5/1994 | Wolfe | 95/901 |

FOREIGN PATENT DOCUMENTS

| | | | |
|---|---|---|---|
| 49-11548 | 3/1974 | Japan | 96/125 |
| 63-51053 | 10/1988 | Japan | 96/125 |

*Primary Examiner*—C. Scott Bushey

*Attorney, Agent, or Firm*—Townsend and Townsend and Crew

[57] ABSTRACT

An air filter device for an air-conditioning apparatus includes a mounting frame unit, an axle mounted rotatably to the mounting frame unit, and a plurality of blade-like frames mounted axially on and projecting radially from a peripheral surface of the axle. The blade-like frames are spaced angularly apart from one another. A plurality of filtering sheets are held respectively by the blade-like frames. Each of the filtering sheets covers an entire area confined by a respective one of the blade-like frames. The filtering sheet includes active carbon fabric felt which is made by weaving activated carbon fiber filaments.

10 Claims, 8 Drawing Sheets

AIR FILTER DEVICE FOR AN AIR-CONDITIONING APPARATUS

BACKGROUND OF THE INVENTION

1. Field of the Invention

This invention relates to an air filter device, more particularly to an air filter device which is applied to an air-conditioning apparatus and which has a plurality of rotatable filtering sheets for filtering effectively and evenly air current through the air-conditioning apparatus.

2. Field of the Invention

Generally speaking, an air-conditioning apparatus has a conventional filter which is installed therewithin at an outlet opening of the air-conditioning apparatus, and through which air flowing outwardly from the air-conditioning apparatus passes to clean the air and to remove solid particles from the flowing air.

In the past, the conventional filter utilizes a netlike sheet similar to a strainer to remove solid particles. However, the netlike sheet cannot absorb foul smell and remove harmful chemical particles carried by the flowing air.

In order to solve above-described drawbacks, some manufacturers provide another type of conventional filter which includes a cellular layer that is made of injection molded plastic, and a large amount of activated carbon powders that is sprayed over porous surfaces of the cellular layer for absorbing foul smell and for removing harmful chemical particles carried by flowing air. In order to fasten effectively the activated carbon powders to the porous surfaces of the cellular layer, an adhesive resin is usually applied to the activated carbon powders. Thus, most of the activated carbon powders may be covered by the adhesive resin. In this way, this type of conventional filter can not effectively absorb foul smell and remove harmful chemical particles carried by the flowing air.

SUMMARY OF THE INVENTION

Therefore, the main objective of the present invention is to provide an air filter device which is to be installed within an air-conditioning apparatus, and which applies a plurality of rotatable filtering sheets, made of woven activated carbon fiber filaments, to filter effectively solid particles and to absorb foul smell carried by air flowing through the air-conditioning apparatus.

Another objective of the present invention is to provide an air filter device whose filtering sheets can be easily dismantled or installed in order to facilitate replacement of dirty filtering sheets with clean ones.

According to this invention, fan air filter device for an air-conditioning apparatus includes a mounting frame unit, an axle mounted rotatably to the mounting frame unit, a plurality of blade-like frames which are mounted axially on and which project radially from a peripheral surface of the axle, and a plurality of filtering sheets held respectively by the blade-like frames.

The mounting frame unit includes vertical left and right frames spaced horizontally apart from each other, and horizontal upper and lower frames interconnecting detachably upper and lower ends of the left and right frames.

The axle has several axially extending dovetail grooves formed in the peripheral surface thereof and spaced angularly apart from one another. Each of the dovetail grooves has two end portions which open respectively in two end surfaces of the axle. The axle has left and right end portions which are journalled respectively in the left and right frames of the mounting frame unit.

The blade-like frames are spaced angularly apart from one another. Each of the blade-like frames has two frame halves which have first longitudinal sides that are hinged to each other, and second longitudinal sides that are opposite to the first longitudinal sides. The frame halves of each of the blade-like frames have two elongated flanges which project respectively and outwardly from the second longitudinal sides thereof in opposite directions. The elongated flanges of each of the blade-like frames act as a retaining means and can be inserted into a respective one of the dovetail grooves when the frame halves are folded one over the other. The elongated flanges have the same length as that of the dovetail grooves.

In addition, each of the frame halves has reinforcing ribs mounted securely thereon for clamping each of the filtering sheets.

Each of the filtering sheets is sandwiched between the frame halves of a respective one of the blade-like frames and covers an entire area confined by a respective one of the blade-like frames. The filtering sheet includes active carbon fabric felt which is made of activated carbon fiber filaments.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 7:
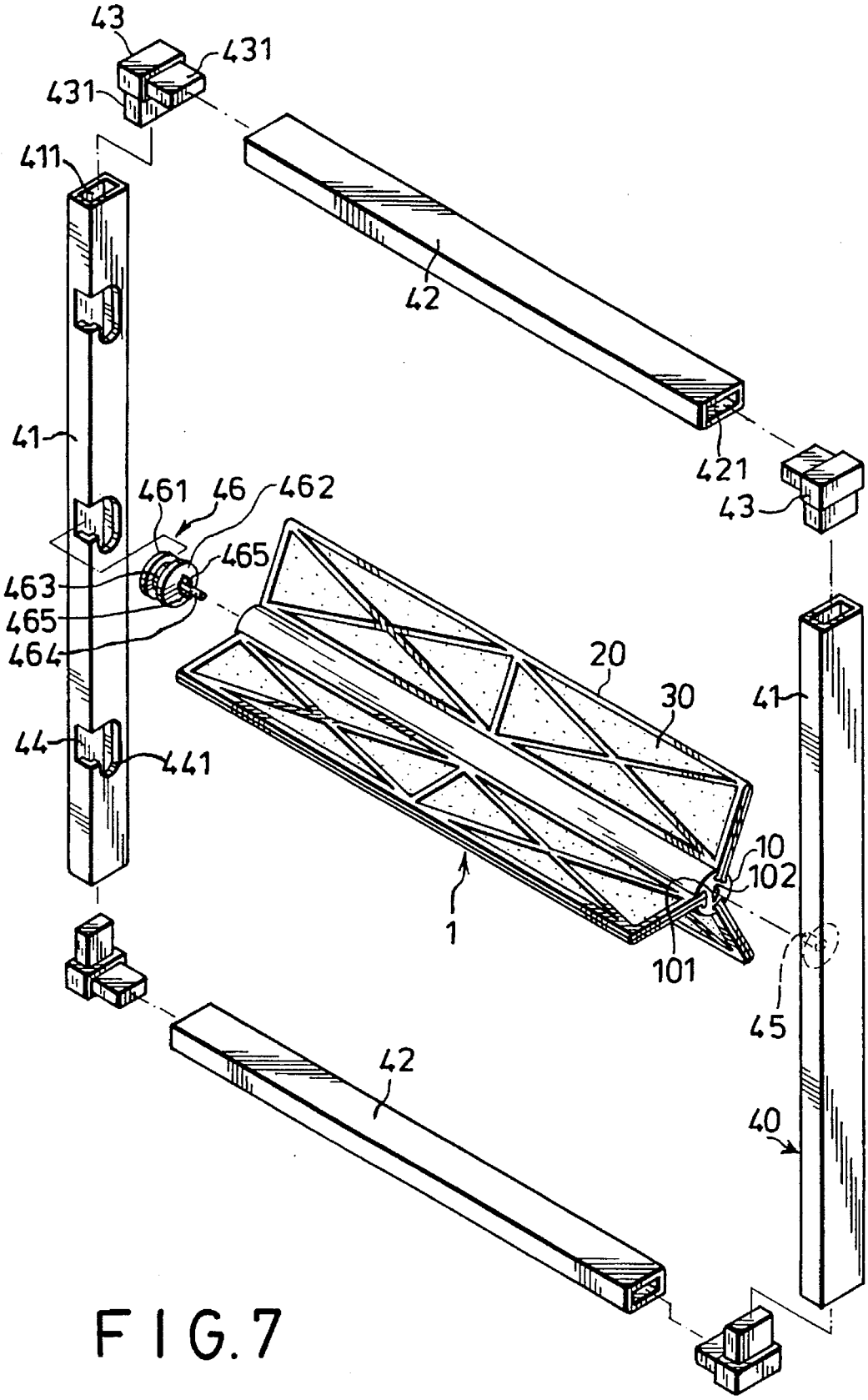
FIG. 7 is an exploded view of a mounting frame unit for carrying the portion of the air filter device in FIG. 1 in accordance with this invention.
Figure 8:
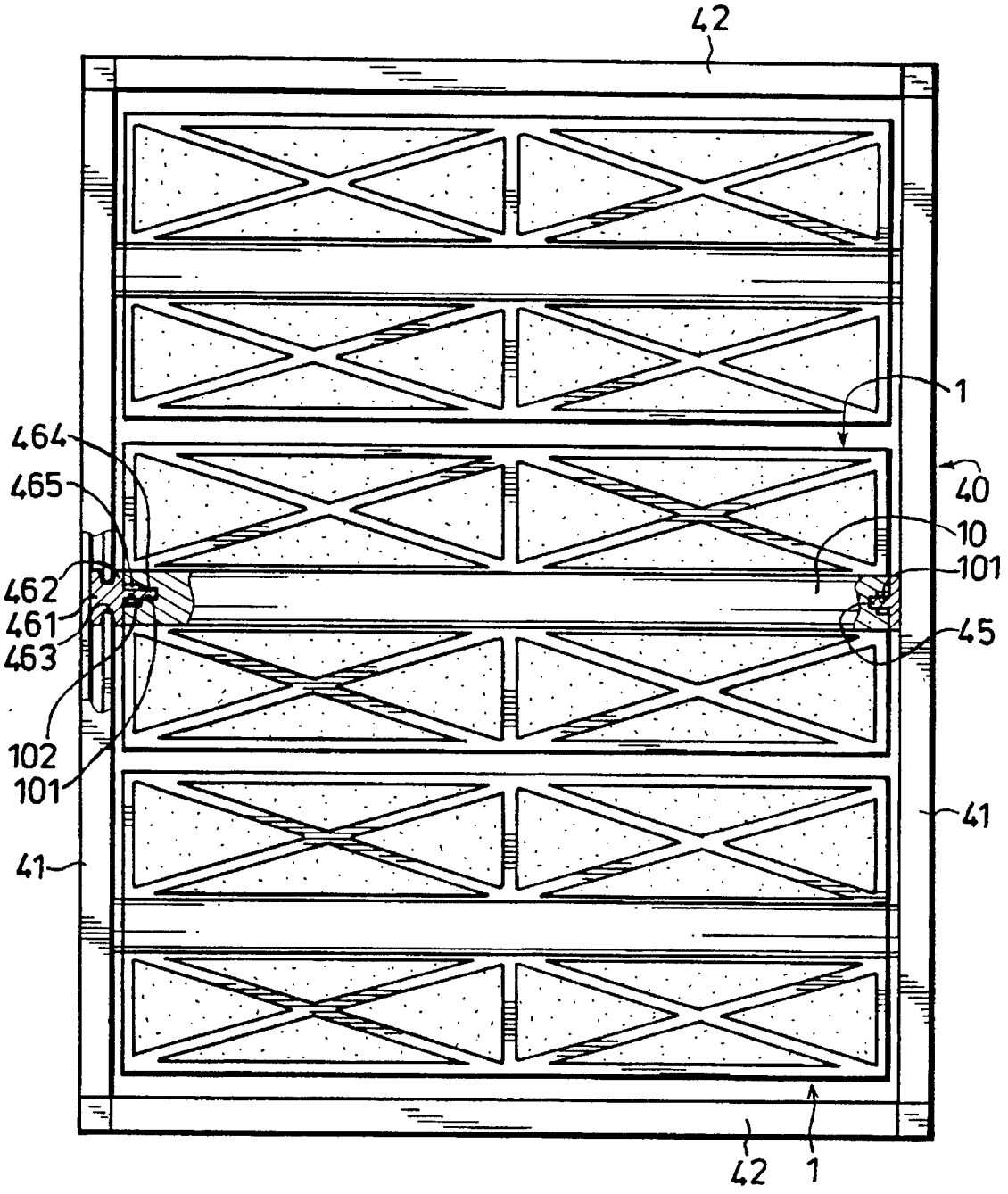
FIG. 8 is an elevational front view illustrating three of the portions shown in FIG. 1 when mounted on the mounting frame unit in accordance with this invention.

Referring to FIGS. 7 and 8, the preferred embodiment of an air filter device 1 according to this invention is to be applied to an air-conditioning apparatus, and includes three axles 10 (only one is shown in FIG. 7) and a mounting frame unit 40 for carrying the axles 10. Each of the axles 10 is provided with three blade-like frames 20. Each of the blade-like frames 20 carries a filtering sheet 30.

The mounting frame unit 40 is to be installed within the air-conditioning apparatus adjacent to an outlet opening of the air-conditioning apparatus, and includes vertical left and right tube-like frames 41 which are spaced horizontally apart from each other and horizontal upper and lower tube-like frames 42 which interconnect the left and right tube-like frames 41 by means of four connectors 43. Each of the connectors 43 has two insert portions 431 to be inserted respectively into any two adjacent axially extending passageways 411, 421 of the tube-like frames 41, 42 in order to constitute a looped frame. In addition, the left frame 41 has three openings 44 formed in an inner face thereof and communicated with the passageway 411 thereof. Each of the openings 44 has a downwardly extending receiving portion 441.

The mounting frame unit 40 further includes three right externally splined shafts 45 (only one is shown) which are mounted rotatably on an inner face of the right frame 41 in a known manner, and three rotary members 46 (only one is shown) which are mounted removably and rotatably on the inner face of the left frame 41 and which are aligned respectively with the right externally splined shafts 45. Each of the rotary members 46 is a sheave and includes a first wheel portion 461 which is inserted into the passageway 411 of the left frame 41 via the opening 44 in a known manner, and a second wheel portion 462 disposed outwardly of the left frame 41 such that an axle 463 which interconnects the first and second wheel portions 461, 462 is disposed within the receiving portion 441. Thus, the rotary member 46 can be installed removably and rotatably on the left frame 41. In addition, each of the rotary members 46 further has a left externally splined shaft 464 which projects outwardly from the second wheel portion 462 along a rotatable axis of the rotary member 46 toward the corresponding right externally splined shaft 45.

Figure 1:
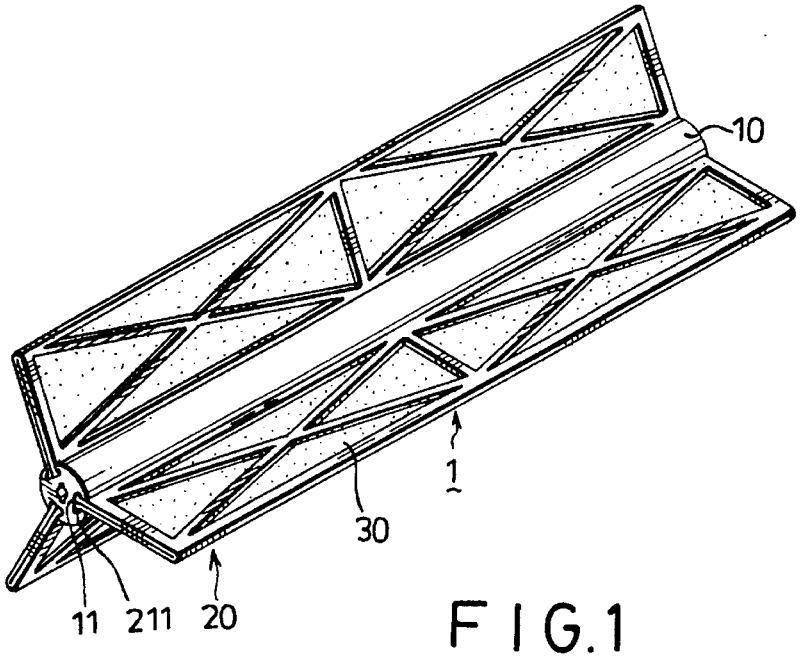
FIG. 1 is a perspective view showing a portion of an air filter device according to the preferred embodiment of this invention.
Figure 2:
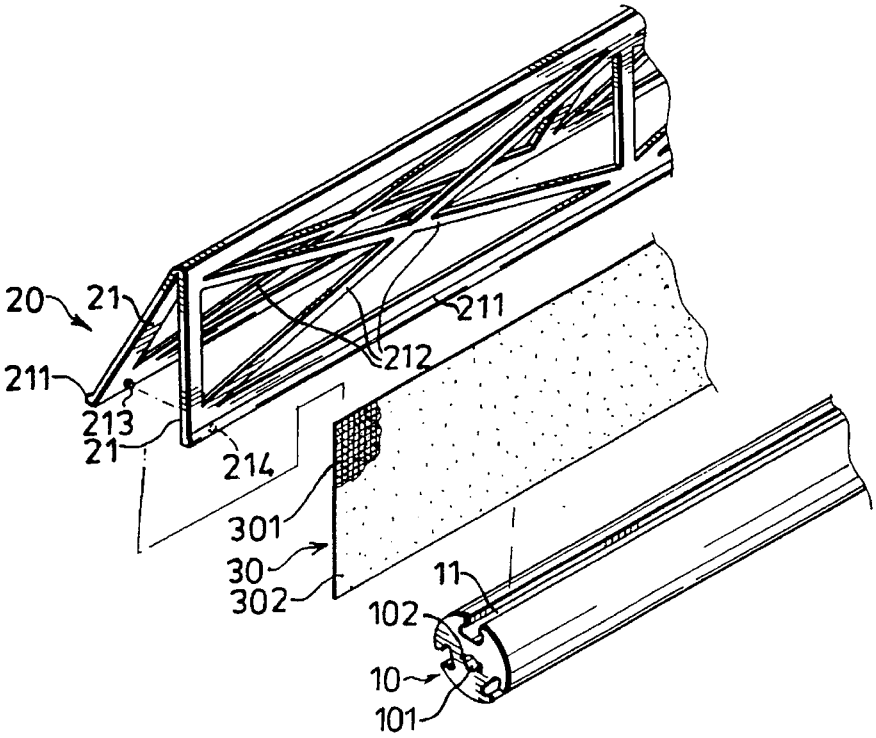
FIG. 2 is an exploded view showing the portion of the air filter device of FIG. 1.

Referring to FIGS. 1 and 2, each of the axles 10 has three axially extending dovetail grooves 11 (see FIG. 2) formed in a peripheral surface thereof and spaced angularly apart from one another. Each of the dovetail grooves 11 has two end portions which open respectively in two end surfaces of the axle 10. Each of the axles 10 further has left and right internally splined holes 101 (only the left one is shown) Which are formed respectively in the end surfaces of the axle 10 and which extend into the axis of the axle 10 at a predetermined distance.

Referring again to FIGS. 7 and 8, the left and right externally splined shafts 464, 45 engage respectively the left and right internally splined holes 101 for carrying the axle 10 between the left and right frames 41, and have wing portions 465 (shown only in the left externally splined shaft 464) that engage respectively positioning holes 102 (see FIG. 8) in a known manner for rotating the axle 10 simultaneously with the left and right externally splined shafts 464, 45.

Figure 6:
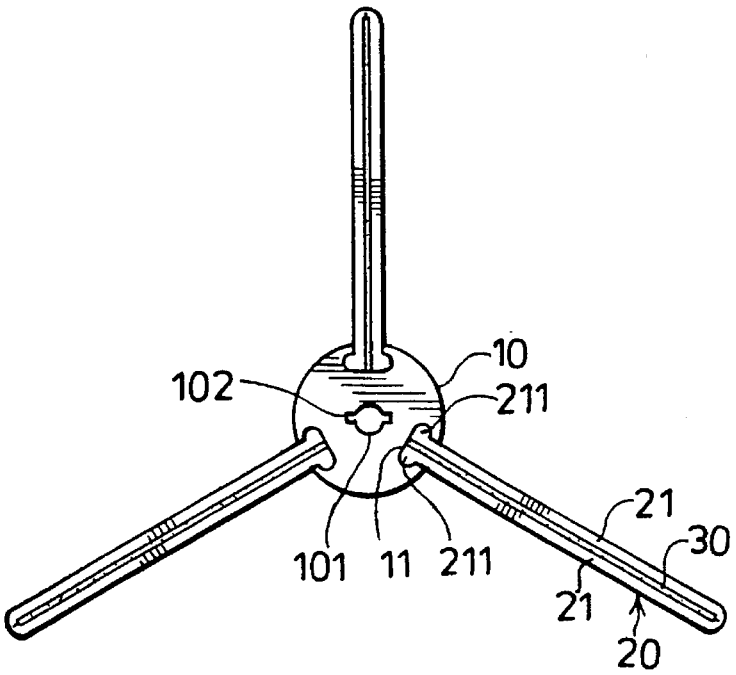
FIG. 6 is a schematic view illustrating how the blade-like frames are mounted removably and rotatably on an axle of the air filter device in accordance with this invention.

Referring again to FIG. 2, each of the blade-like frames 20 has two frame halves 21 with first longitudinal sides that are hinged to each other, and second longitudinal sides that are opposite to the first longitudinal sides and that can be coupled detachably to each other by means of a pin 213 which projects from one of the second longitudinal sides so as to engage a hole 214 on the other one of the second longitudinal sides. The frame halves 21 of each of the blade-like frames 20 further have two elongated flanges 211 which project respectively and outwardly from the second longitudinal sides thereof in opposite directions. The elongated flanges 211 of each of the blade-like frames 20 act as a retaining means and can be inserted into a respective one of the dovetail grooves 11 of the axle 10 when the frame halves 21 are folded one over the other, as shown in FIGS. 1 and 6. It is noted that the elongated flanges 211 have the same length as that of the dovetail grooves 11 and can be removed from the end portions of the dovetail grooves 11.

Figure 4:
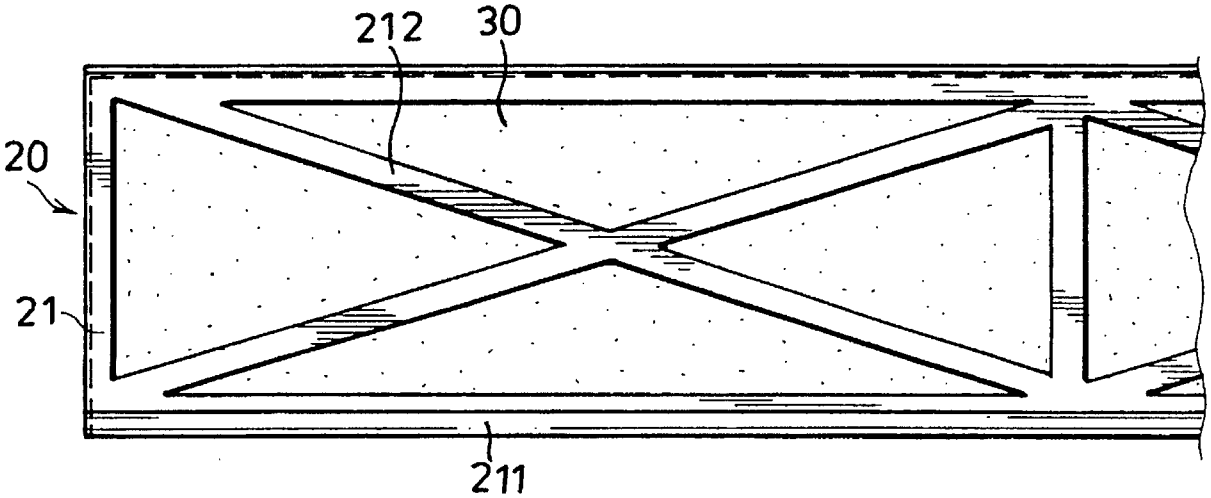
FIG. 4 is an elevational view showing one of the blade-like frames of the air filter device according to this invention.
Figure 5:
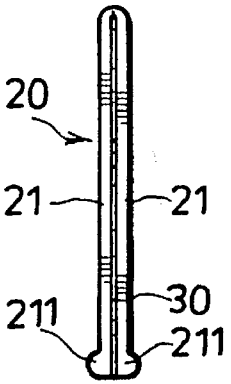
FIG. 5 is a schematic view illustrating how the filtering sheet is held by the blade-like frame of the air filter device in accordance with this invention.

Referring to FIGS. 2, 4 and 5, each of the filtering sheets 30 is sandwiched between the frame halves 21 of a respective one of the blade-like frames 20, and covers an entire area confined by the blade-like frame 20 for blocking a path along which air-is blown from the air-conditioning apparatus to its outlet opening, thereby allowing the filtering sheets 30 to filter the air flowing therethrough. At the same time, the flowing air enables the assembly of the blade-like frames 20 and the filtering sheets 30 to rotate simultaneously with the axle 10 about the axis of the axle 10.

Accordingly, the assembly of the blade-like frames 20 and the filtering sheets 30 does not retard the flowing air when the air-conditioning apparatus is in use. In addition, each of the frame halves 21 has reinforcing ribs 212 mounted securely thereon for further clamping each of the filtering sheets 30 between the frame halves 21 of a respective one of the blade-like frames 20.

Figure 3:
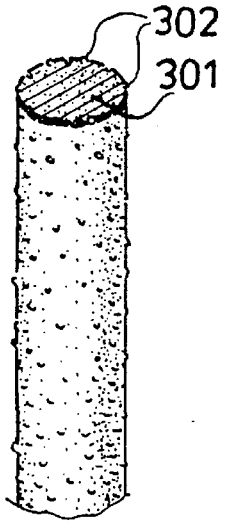
FIG. 3 is an enlarged view showing an activated carbon fiber filament which can be weaved to form filtering sheets of the air filter device according to this invention.

It is noted that the filtering sheets 30 include activated carbon fabrics which are made by weaving activated carbon fiber filaments 301, as shown in FIGS. 2 and 3. The activated carbon fiber filaments 301 have porous surfaces 302 which are capable of absorbing foul smell and filtering harmful chemical particles carried by the flowing air. Because the filtering sheets 30 are held by the blade-like frames 20, there is no need to apply an adhesive resin to fasten the activated carbon fiber filaments 301. Thus, the porous surfaces 302 of the activated carbon fiber filaments 301 can clean effectively the air flowing from the air-conditioning apparatus.

In addition, it is quite convenient to replace dirty filtering sheets 30, when used for a long term, with clean ones by removing the axles 10 from the mounting frame unit 40 and then removing the blade-like frames 20 from the dovetail grooves 11 of the axles 10. Thus, the dirty filtering sheets 30 can be removed from the blade-like frames 20 by opening the frame halves 21.

Figure 9:
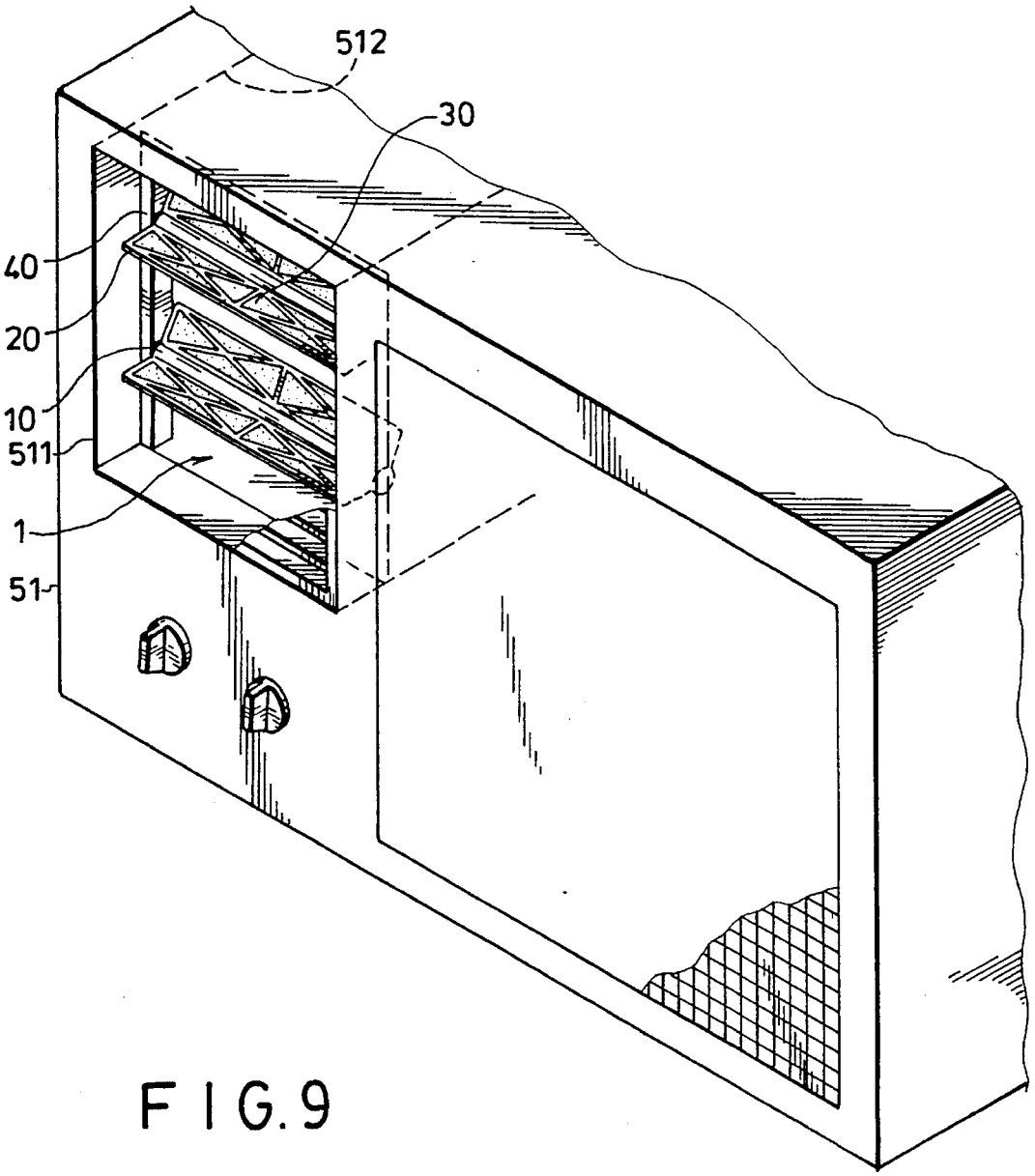
FIG. 9 is a schematic view illustrating how the air filter device of this invention is applied to an air conditioner.

FIG. 9 shows how the air filter device 1 of this invention is applied to an air conditioner 51. As shown, the mounting frame unit 40 of the air filter device 1 is installed within a passageway 512 of the air conditioner 51 adjacent to an outlet opening 511. The axles 10 of the air filter device 1 are mounted rotatably on the mounting frame unit 40 for carrying the assembly of the blade-like frames 20 and the filtering sheets 30 so as to filter air flowing from the air conditioner 51.

It is noted that the rotation of the axles 10 by virtue of the flowing air enables the filtering sheets 30 to clean effectively and evenly the latter.

Figure 10:
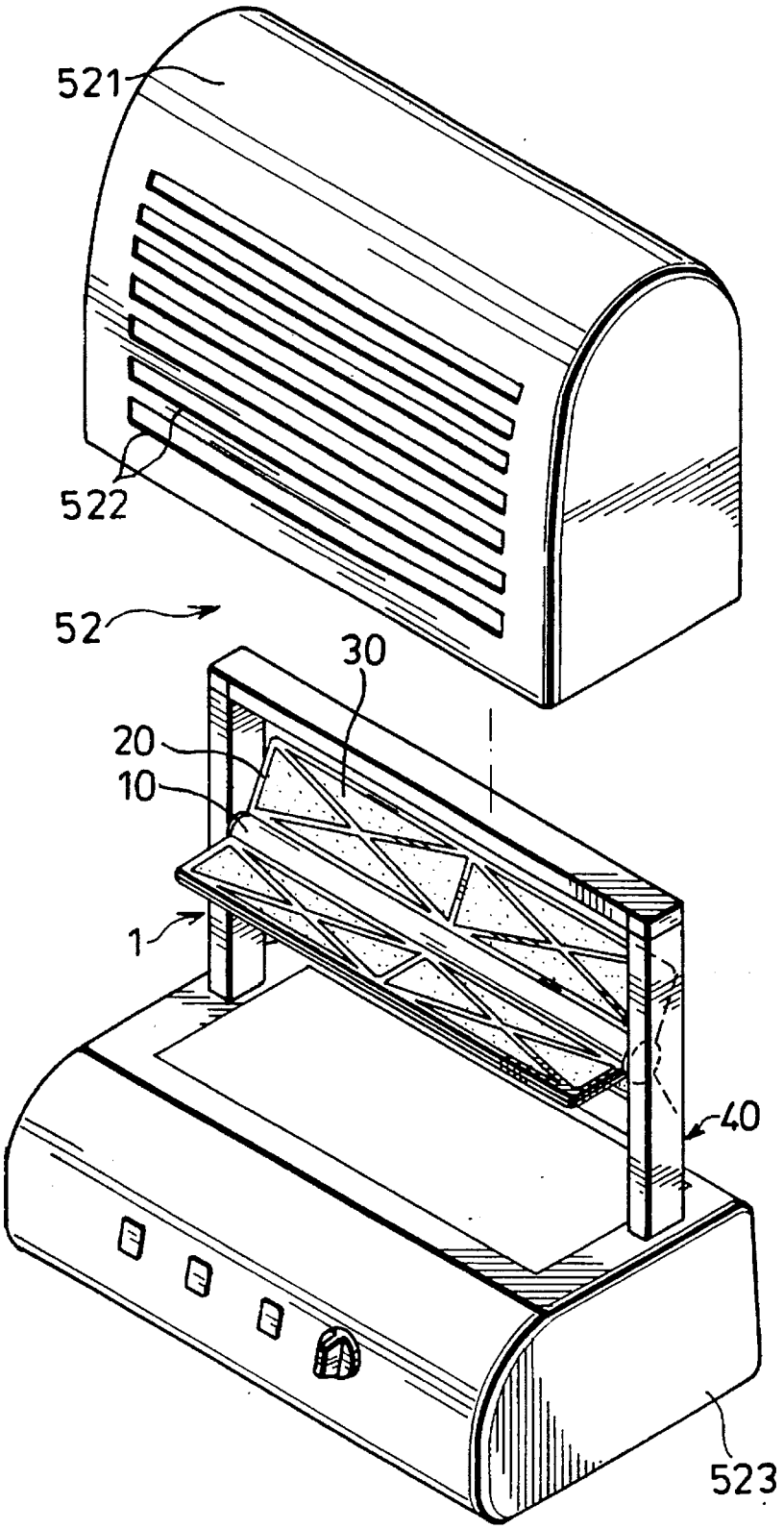
FIG. 10 is a schematic view illustrating how the air filter device of this invention is applied to an air purifier.

FIG. 10 shows how the air filter device 1 of this invention is applied to an air purifier 52. As shown, the air purifier 52 includes a main body 523 with the mounting frame unit 40 of the air filter device 1 installed thereon, and a cover 521 with several outlet openings 522 formed therethrough. The axle 10 of the air filter device 1 is mounted rotatably on the mounting frame unit 40 for carrying the assembly of the blade-like frames 20 and the filtering sheets 30.

It is noted that the axle 10 can be driven by a motor (not shown) within the main body 523 in a known manner so as to be rotated thereby. Thus, the rotation of the assembly of the blade-like frames 20 and the filtering sheets 30 can induce air into the air purifier 52 via inlet openings (not shown) of the air purifier 52. Then, clean air can flow outwardly of the air purifier 52 via the outlet openings 522.

Figure 11:
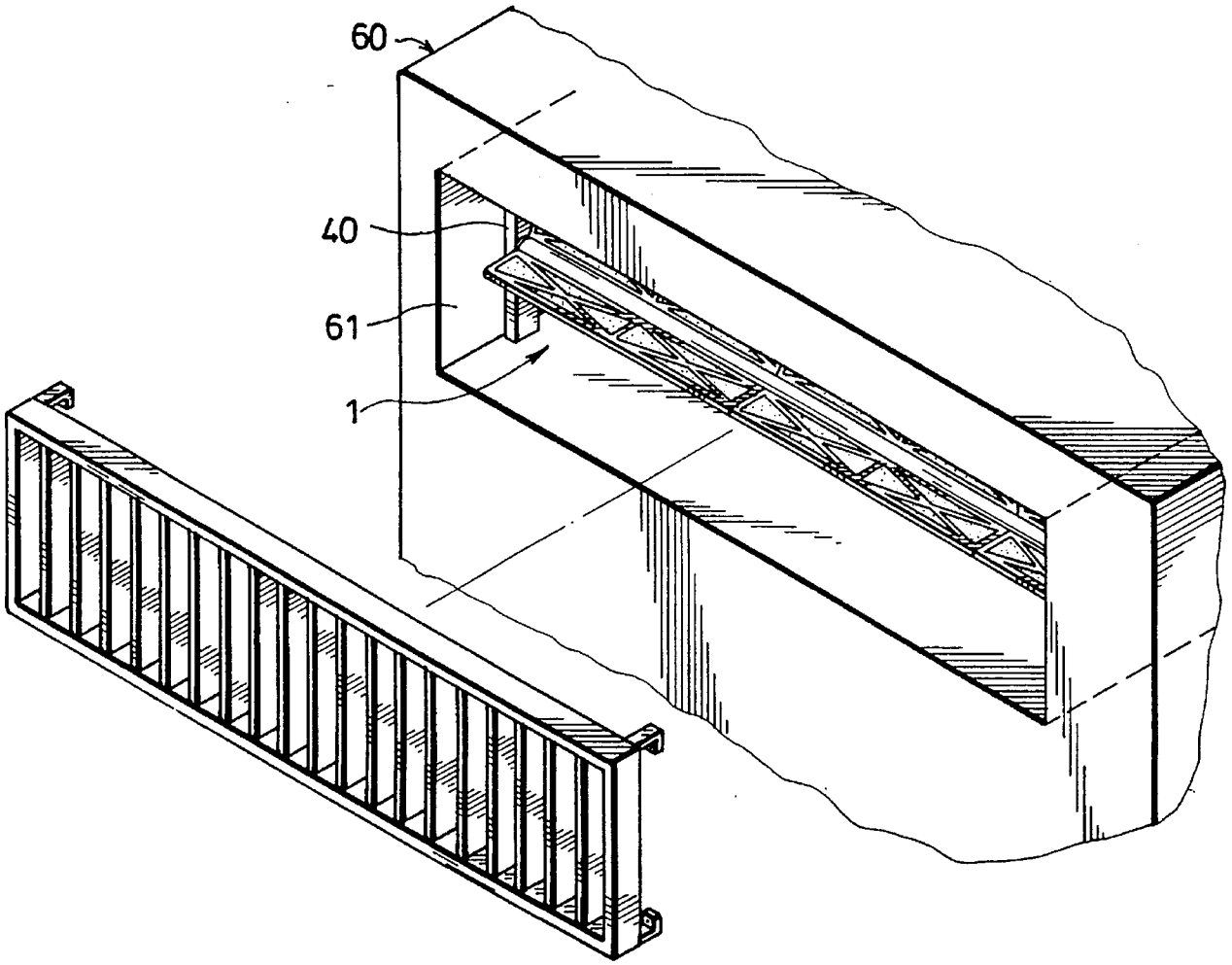
FIG. 11 is a schematic view illustrating how the air filter device of this invention is applied to a centralized air conditioning system.

FIG. 11 shows how the air filter device 1 of this invention is applied to a centralized air conditioning system 60. As shown, the mounting frame unit 40 of the air filter device 1 is installed within a passageway 61 which is located in a wall, and along which air flows outwardly from the centralized air conditioning system 60. Other parts of the air filter device 1 are mounted rotatably on the mounting frame unit 40 for filtering the air from the centralized conditioning system 1.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. An air filter device for an air-conditioning apparatus, comprising:

a mounting frame unit;

an axle mounted rotatably to said mounting frame unit;

a plurality of blade-shaped frames mounted axially on and projecting radially from a peripheral surface of said axle, said frames being spaced angularly apart form one another; and a plurality of filtering sheets held respectively by said frames, each of said filtering sheets covering an entire area defined by a respective one of said frames;

said axle having several axially extending dovetail grooves formed in said peripheral surface thereof and spaced angularly apart from one another, each of said dovetail grooves having first and second end portions which open respectively in first and second end surfaces of said axle;

each of said frames having retaining means for removably engaging a respective one of said dovetail grooves for retaining said frames on said axle.

2. An air filter device as claimed in claim 1, wherein each of said filtering sheets includes active carbon fabric felt which is made of activated carbon fiber filaments.

3. An air filter device as claimed in claim 1, wherein each of said frames has two frame halves which have first longitudinal sides that are hinged to each other, and second longitudinal sides that are opposite to said first longitudinal sides, said frame halves of each of said frames having two elongated flanges which project outwardly from said second longitudinal sides thereof in opposite directions, and which act as said retaining means so as to be inserted into a respective one of said dovetail grooves when said frame halves are folded one over the other, said elongated flanges having the same length as that of said dovetail grooves, each of said filtering sheets being sandwiched between said frame halves of a respective one of said frames.

4. An air filter device as claimed in claim 3, wherein each of said frame halves has reinforcing ribs mounted securely thereon for clamping each of said filtering sheets.

5. An air filter device as claimed in claim 1, wherein said mounting frame unit includes vertical left and right frames spaced horizontally apart from each other, and horizontal, upper and lower frames interconnecting detachably upper and lower ends of said left and right frames.

6. An air filter device as claimed in claim 5, wherein said axle has left and right end portions which are journalled respectively in said left and right frames of said mounting frame unit.

7. An air filter device as claimed in claim 6, wherein said axle has left and right internally splined holes which are formed respectively in end surfaces of said left and right end portions thereof and which extend into said axis of said axle at a predetermined distance, said mounting frame unit further including a right externally splined shaft mounted rotatably on an inner face of said right frame to engage said right internally splined hole of said axle, and a rotary member mounted removably and rotatably on an inner face of said left frame, said rotary member having a left externally splined shaft projecting from and along an axis of rotation of said rotary member toward said right externally splined shaft, said left externally splined shaft being engageable with said left internally splined hole of said axle so as to carry said axle rotatably between said left and right frames.

8. An air filter device for an air-conditioning apparatus, comprising:

a mounting frame unit including vertically oriented left and right frames spaced horizontally apart from each other and horizontally oriented upper and lower frames detachably interconnecting upper and lower ends of said left and right frames;

an axle rotatably mounted to said mounting frame unit and having left and right end portions respectively journalled in said left and right frames of said mounting frame unit, said axle further including left and right internally splined holes respectively formed in end surfaces of said left and right end portions thereof and extending a predetermined distance into said axle;

said mounting frame unit including a right externally splined shaft rotatably mounted on an inner face of said right frame to engage said right internally splined hole of said axle, and a rotary member removably and rotatably mounted on an inner face of said left frame, said rotary member having a left externally splined shaft projecting from and along an axis of rotation of said rotary member toward said right externally splined shaft, said left externally splined shaft being engageable with said left internally splined hole of said axle for rotatably carrying said axle between said left and right frames;

a plurality of blade-shaped frames mounted axially on and projecting radially from a peripheral surface of said axle, said frames being spaced angularly apart form one another; and a plurality of filtering sheets held respectively by said frames, each of said filtering sheets covering an entire area defined by a respective one of said frames.

9. An air filter device as claimed in claim 8, wherein said axle has several axially extending dovetail grooves formed in said peripheral surface thereof and spaced angularly apart from one another, each of said dovetail grooves having two end portions which open respectively in two end surfaces of said axle.

10. An air filter device as claimed in claim 9, wherein each of said frames has retaining means to engage removably a respective one of said dovetail grooves for retaining said frames on said axle.

* * * * *